US006758074B1

(12) United States Patent
Prunbauer

(10) Patent No.: US 6,758,074 B1
(45) Date of Patent: Jul. 6, 2004

(54) HIGH-SECURITY ROUND KEY AND LOCK THEREFOR

(75) Inventor: Kurt Prunbauer, Herzogenburg (AT)

(73) Assignee: Evva-Werk Spezialerzeugung Von Zylinder-und Sicherheitsschlossern Gesellschaft m.b.H. & Co. KG, Vienna (AT)

( * ) Notice: Subject to any disclaimer, the term of this patent is extended or adjusted under 35 U.S.C. 154(b) by 0 days.

(21) Appl. No.: 10/404,019

(22) Filed: Mar. 31, 2003

(30) Foreign Application Priority Data

Mar. 29, 2002 (AT) ..... 504/2002

(51) Int. Cl.[7] ..... E05B 19/02; E05B 19/06; E05B 29/04

(52) U.S. Cl. ..... 70/366; 70/403; 70/409

(58) Field of Search ..... 70/346, 347, 356, 70/358, 365, 366, 392, 403, 404, 406, 407, 409, 420, 492, 495

(56) References Cited

U.S. PATENT DOCUMENTS

| | | | | | |
|---|---|---|---|---|---|
| 991,363 | A | * | 5/1911 | Polsen | 70/99 |
| 1,616,255 | A | * | 2/1927 | Douglas | 70/366 |
| 1,888,383 | A | * | 11/1932 | Holton | 70/149 |
| 2,039,126 | A | * | 4/1936 | Svoboda | 70/358 |
| 2,157,142 | A | * | 5/1939 | Olson | 70/406 |
| 3,035,433 | A | * | 5/1962 | Testa | 70/495 |
| 3,137,156 | A | * | 6/1964 | Navarro | 70/492 |
| 3,264,852 | A | * | 8/1966 | Fritz | 70/358 |
| 4,270,372 | A | * | 6/1981 | Vonlanthen et al. | 70/406 |
| 4,370,875 | A | * | 2/1983 | Piiroinen | 70/422 |
| 4,418,555 | A | * | 12/1983 | Uyeda | 70/366 |
| 4,516,416 | A | * | 5/1985 | Prunbauer et al. | 70/276 |
| 4,860,562 | A | * | 8/1989 | Koren et al. | 70/352 |
| 4,977,767 | A | | 12/1990 | Prunbauer | 70/406 |

FOREIGN PATENT DOCUMENTS

| | | | | |
|---|---|---|---|---|
| DE | 2627764 | * | 1/1977 | 70/366 |
| EP | 0103532 | * | 3/1984 | 70/495 |

* cited by examiner

*Primary Examiner*—Lloyd A. Gall
(74) *Attorney, Agent, or Firm*—Herbert Dubno; Andrew Wilford

(57) ABSTRACT

A key has a blade formed with a part-cylindrical face and with a pair of relatively shallow, outwardly open, and generally parallel but spaced grooves formed in the face extending generally longitudinally in a nonstraight path and a relatively deep and outwardly open groove formed in the face and extending generally longitudinally in a nonstraight path generally nonparallel to the shallow grooves. The grooves each have a plurality of control positions at which they extend substantially parallel to the blade and are inclined to the blade between the respective control positions. The control positions of the shallow grooves are transversely aligned and staggered relative to the control positions of the deep groove

19 Claims, 7 Drawing Sheets

HIGH-SECURITY ROUND KEY AND LOCK THEREFOR

FIELD OF THE INVENTION

The present invention relates to a key and lock. More particularly this invention concerns such a key and lock designed for particular high-security applications.

BACKGROUND OF THE INVENTION

In my U.S. Pat. No. 4,977,767 I describe a flat key having a blade formed with a pair of opposite edges, with a pair of opposite faces between the edges, and with an outer-end tip. In addition this blade is formed with bitting along at least one of its edges, with a pair of relatively shallow, outwardly open, and generally parallel but spaced grooves formed in at least one of the faces extending generally longitudinally in a nonstraight path from the tip, and with a relatively deep and outwardly open groove formed in the one face and extending generally longitudinally in a nonstraight path from the tip generally nonparallel to the shallow grooves.

Such a system is extremely effective, but the relatively thin blade of the key is unable to exert considerable torque and is often broken. Furthermore the in-line axial arrangement of the parts of the lock make it susceptible to sophisticated picking.

OBJECTS OF THE INVENTION

It is therefore an object of the present invention to provide an improved key.

A further object is to provide an improved lock for the key.

Another object is the provision of such an improved key and lock which are particularly robust and pick-resistant.

SUMMARY OF THE INVENTION

A key according to the invention has a blade formed with a part-cylindrical face and with a pair of relatively shallow, outwardly open, and generally parallel but spaced grooves formed in the face extending generally longitudinally in a nonstraight path and a relatively deep and outwardly open groove formed in the face and extending generally longitudinally in a nonstraight path generally nonparallel to the shallow grooves. The grooves each have a plurality of control positions at which they extend substantially parallel to the blade and are inclined to the blade between the respective control positions. The control positions of the shallow grooves are transversely aligned and staggered relative to the control positions of the deep groove.

Thus with this system the key is extremely hard to duplicate. As a result clandestine copying is virtually ruled out. Furthermore the three-dimensional shape of the key face and similar three-dimensional shape of the control grooves allows the key to carry a very complex coding. This can be made even more complex by undercutting the grooves so as to coact with appropriately shaped tumbler formations. The groove walls can be set nonparallel to a diametral plane, so that one wall is in effect undercut.

The key can be solid. It can also be hollow, in which case a nearly-semicylindrical shells can be welded to a tubular core and the grooves can be formed in the shell. This procedure makes it much easier to manufacture a key according to the invention.

In accordance with the invention the deep groove is mainly between the shallow grooves. Furthermore the grooves all flare axially toward a tip of the key.

In another key according to the invention the key blade is cylindrical and has a second part-cylindrical face substantially identical to the first-mentioned part-cylindrical face and formed with second shallow and deep grooves like the first-mentioned shallow and deep grooves. In this case the key is reversible. When a tubular key is employed, it is formed with longitudinal diametrally opposite ridges between which groove-carrying semicylindrical shells are secured. Whether the key is solid or tubular, in this reversible system the key blade is substantially symmetrical to a plane extending between the first and second faces.

To further increase security the blade is formed with at least one axially extending ward formation, normally a groove. In a reversible key, there are two such ward grooves.

For maximum coding possibilities the control positions or each groove are angularly offset from one another. At least three angularly offset positions are possible for each groove, and as many as four, five, or more can easily be provided to maximize security.

The invention further concerns a lock usable with the above-described key and comprising a relatively stationary lock housing, a lock cylinder rotatable in the housing about an axis and formed with an axially outwardly open passage shaped to snugly receive the key blade, a first tumbler angularly displaceable in the cylinder and provided with a first formation engageable generally radially of the axis in the deep groove, and a second tumbler angularly displaceable in the cylinder and provided with a second formation engageable generally radially of the axis in the shallow grooves, whereby the tumblers are shifted angularly on insertion of the key by interengagement of the formations and the respective grooves. A lock element is displaceable in only one predetermined angular position of the tumblers between a position blocking rotation of the cylinder in the housing and a position permitting such rotation.

Normally according to the invention the second tumbler has two such second formations each complementary to a respective one of the shallow grooves and fixedly spaced angularly of the key blade relative to each other. In addition the tumblers are flat annular disks surrounding and defining the passage and lying in planes substantially perpendicular to the axis and the lock is provided with a plurality of such first and second tumblers spaced axially with spacers between the tumblers.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
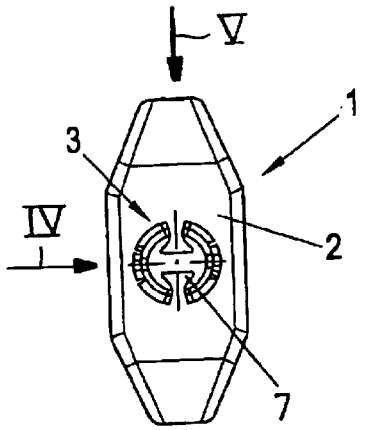
FIG. 1 is an end view of a key according to the invention.
Figure 2:
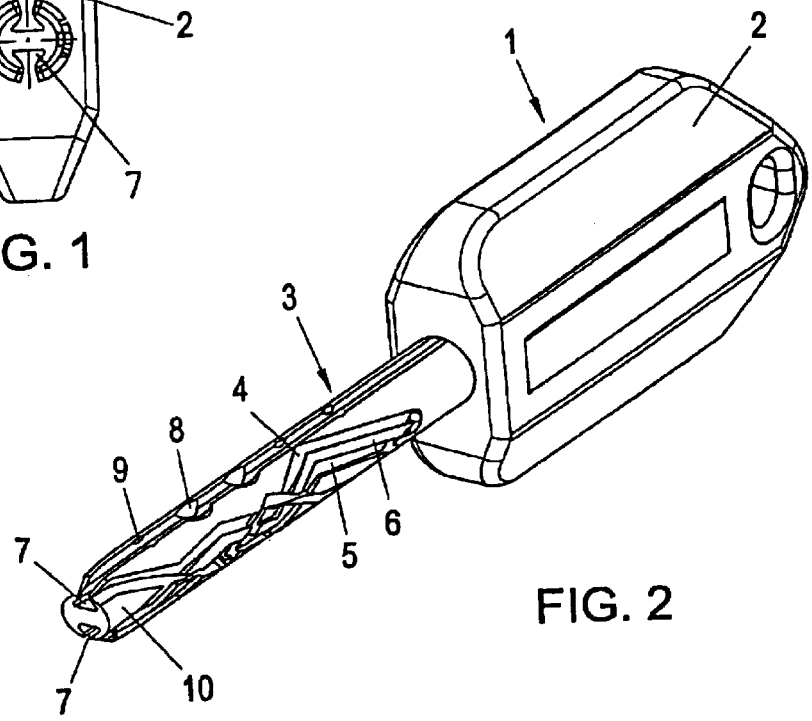
FIGS. 2 and 3 are perspective views of the left-and right-hand sides of the key.
Figure 3:
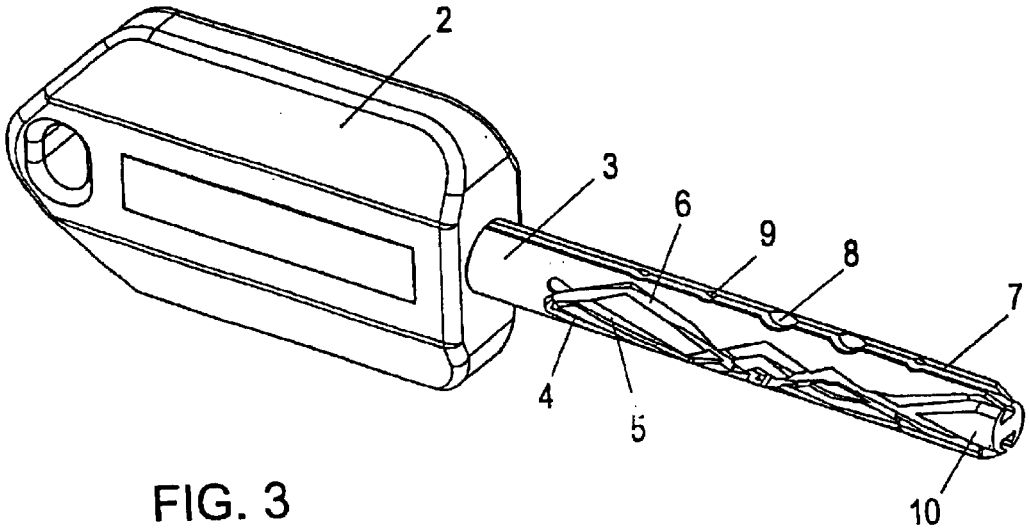
Figure 4:
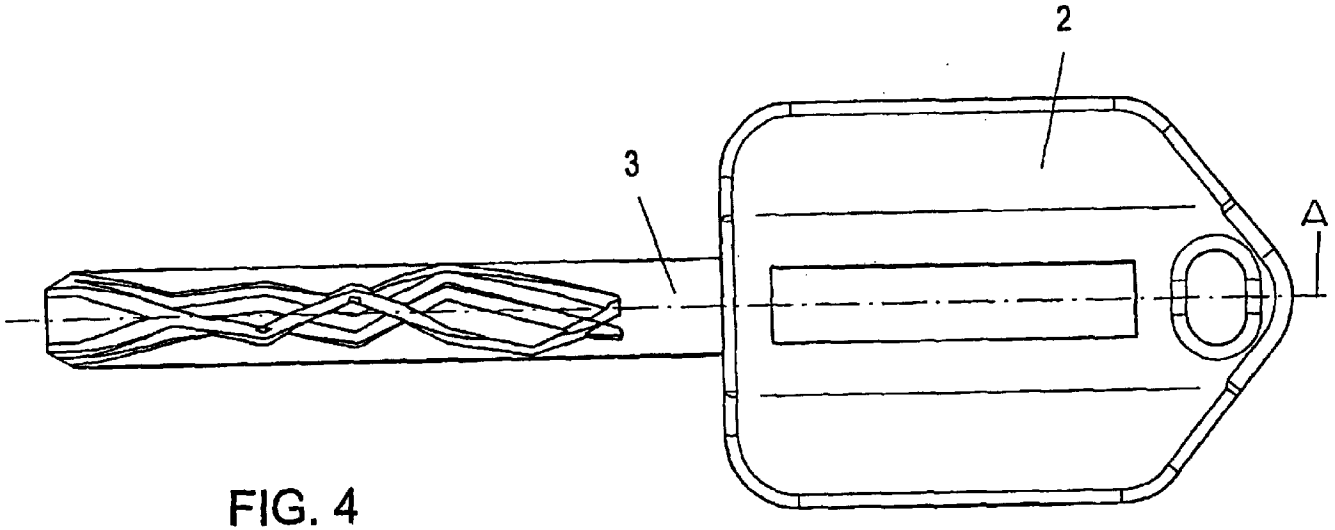
FIGS. 4 and 5 are side and top views taken in the direction of arrows IV and V of FIG. 1, FIGS. 6 and 7 are diagrammatic developed views illustrating the instant invention.
Figure 5:
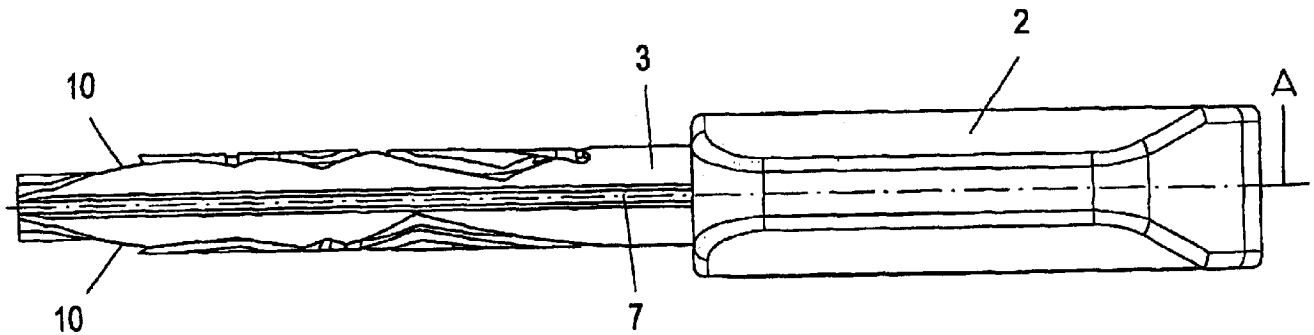

As seen in FIGS. 1 through 5 and 3 a key 1 according to this invention has a bow 2 from which projects a round blade 3 of basically cylindrical shape centered on an axis A and having a pair of semicylindrical faces each formed with three generally longitudinally extending and laterally open nonstraight grooves 4, 5, and 6. In addition the cylindrical blade 3 is formed between the faces formed with the grooves 4, 5, and 6 with a pair of diametrally oppositely opening and axially full-length ward channels 7 of undercut or dovetail section. Furthermore the blade 3 is formed at the channels with radially outwardly open part-spherical pockets 8 and 9.

Figure 6:
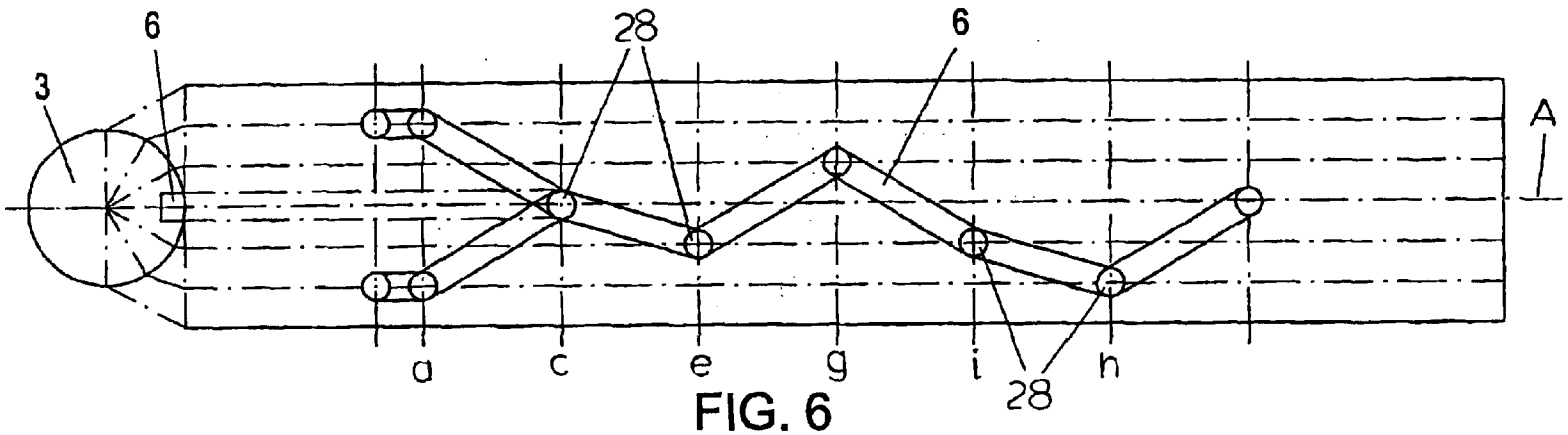
Figure 7:
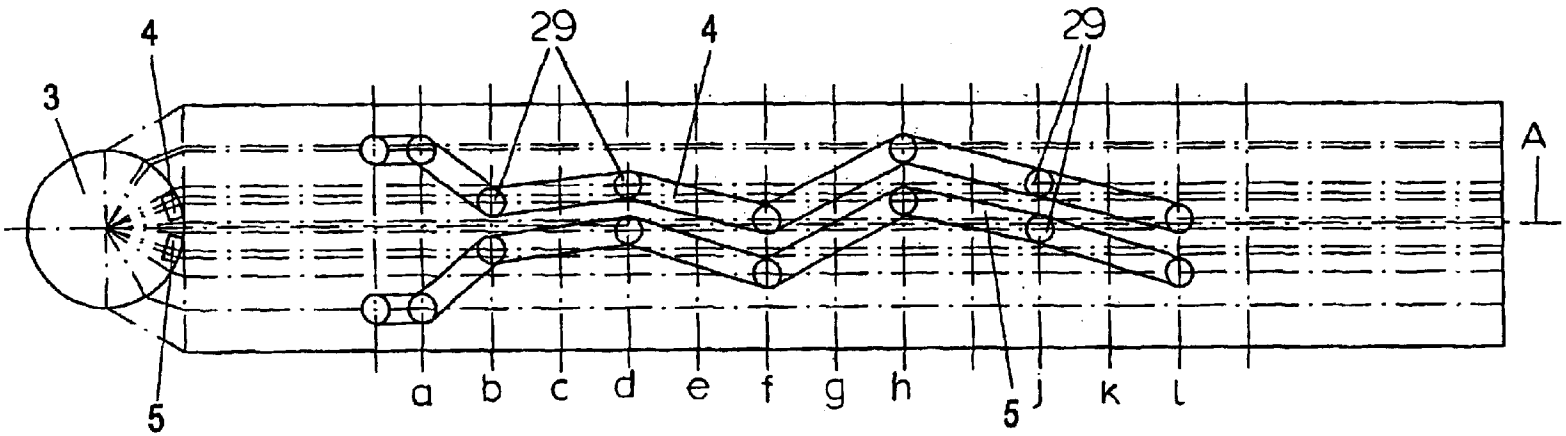
Figure 8:
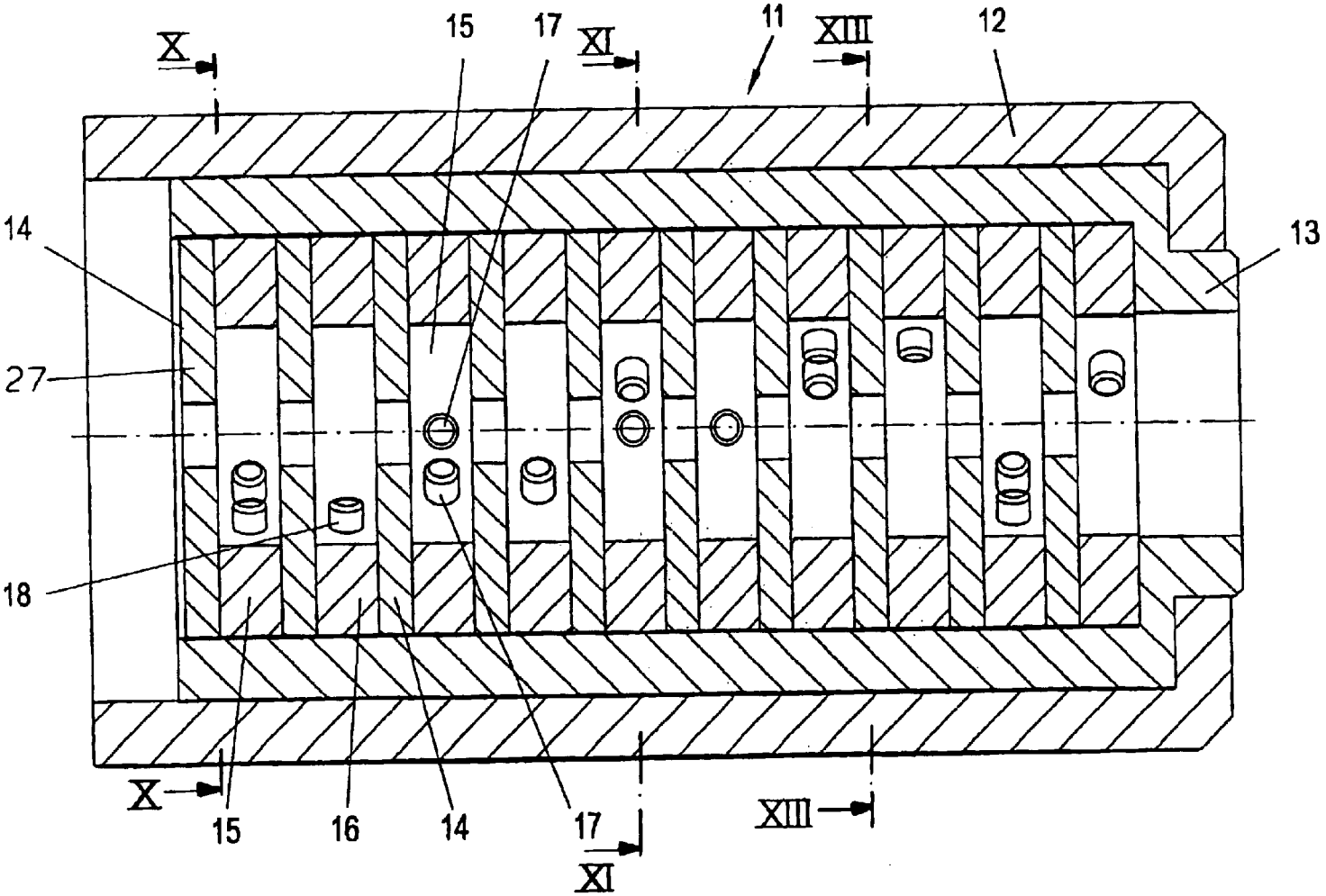
FIG. 8 is an axial section through a lock in accordance with the invention
Figure 9:
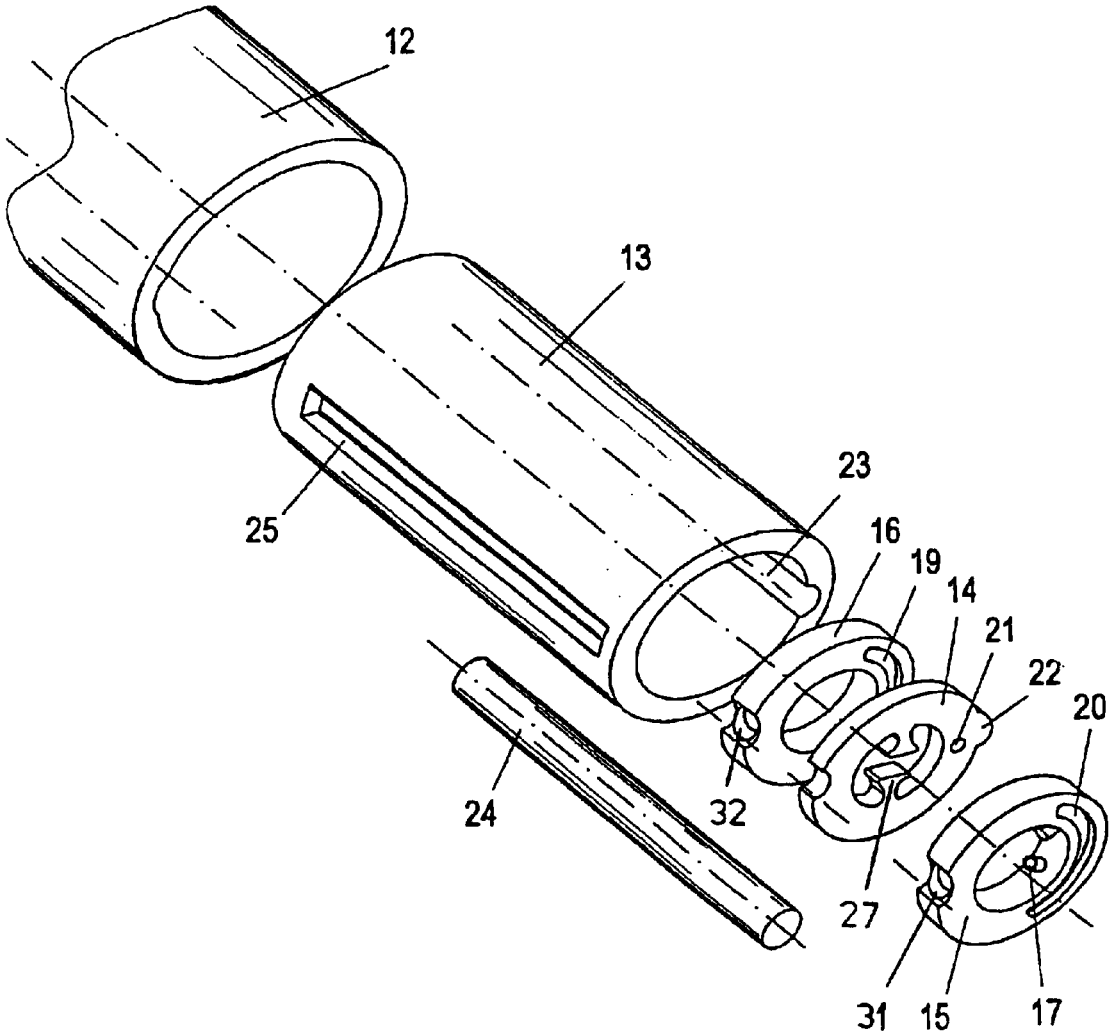
FIG. 9 is an exploded view of the lock.
Figure 10:
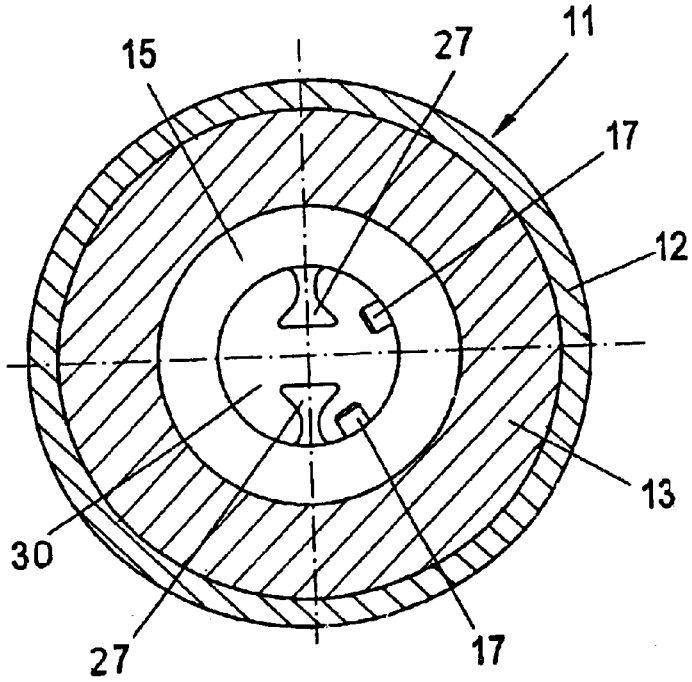
FIG. 10 is a section taken along plane X—X of FIG. 8.

The two grooves 4 and 5 as shown in FIGS. 6 and 7 are of substantially the same width and extend over most of their lengths parallel to each other. They are relatively shallow (see FIGS. 2 and 3). The groove 6 is substantially deeper than the grooves 4 and 5 and does not extend parallel to either of these grooves 4 and 5 over any significant portion of its length. It is inflected at positions 28 at levels indicated at a, c, e, I, and h in FIG. 6 and the grooves 4 and 5 are respectively inflected at positions 29 at levels indicated respectively at b, d, and f and h, J, and l in FIG. 7. The positions 29 of the groove 4 are level with those of the groove 5 but staggered equidistantly between those of the groove 6. The positions 29 here are angularly offset at five different angular positions and the positions 28 at four, making a vast number of combinations possible. The grooves 4, 5, and 6 all widen at 10 at an inner end or tip of the blade 3.

As seen in FIGS. 8 through 13 the lock itself has a normally stationary housing sleeve 12 containing a cylinder or plug 13 centered on and rotatable in the sleeve 12 about an axis A which is the same axis as the key 1 when same is inserted in the lock. The housing 12 has a cylindrical inner wall centered on the axis A and holds ten spacer plates or washers 14 sandwiching tumbler disks 15 and 16 which alternate with each other and which are all of circularly annular or washer shape.

Each plate 14 is formed with a pair of diametrally opposite inwardly projecting ward formations or projections 27 that are complementary to the respective ward channels 7 of the key 7. Furthermore each plate 14 has a radially outwardly projecting bump 22 that fits in a complementary seat 23 (FIG. 13) of the plug 13 formed as an axially extending and radially inwardly open groove of part-cylindrical shape. Thus the plates 14 are rotationally locked to the plug 13. A short pin 21 whose function is described below extends axially through each plate 14 radially offset from the axis A, projecting axially on at least one face of the plate 14.

Each disk 15 is formed with a pair of short pins 17 that project radially inward from its inner periphery and that are shaped to slide axially in the grooves 4 and 5, and each disk 16 is similarly formed with a single long pin 18 that projects radially inward from its inner periphery and that is shaped to slide axially in the respective groove 6. Furthermore the disks 15 and 16 are formed with circularly arcuate and axially open grooves 19 and 20 into which the pins 21 of the respective disks 14 extend, so that each tumbler disk 15 and 16 can only pivot about the axis A in the plug 13 through a limited angle here of somewhat less than 180° (see FIG. 12).

In addition the disks 14, 15 and 16 are formed with respective radially outwardly open and axially extending notches or seats 31, 32, and 33 of part-cylindrical shape. The seats 33 radially confront a radially throughgoing and axially extending slot 25 cut in the sleeve 13, and the housing 11 is itself formed with an axially extending and radially inwardly open groove seat 26 of shape similar to that of the notches 31, 32, and 33. A rod 24 lies in the slot 26 and has a diameter greater than the wall thickness of the sleeve 13 so it must project radially or outwardly therefrom.

The blade 3 illustrated is hollow. It is, however, within the scope of the invention to make it tubular in which case it may carry external parts forming the grooves 4, 5, and 6. The deep groove may in fact extend radially through the wall of such a tubular blade.

Figure 11:
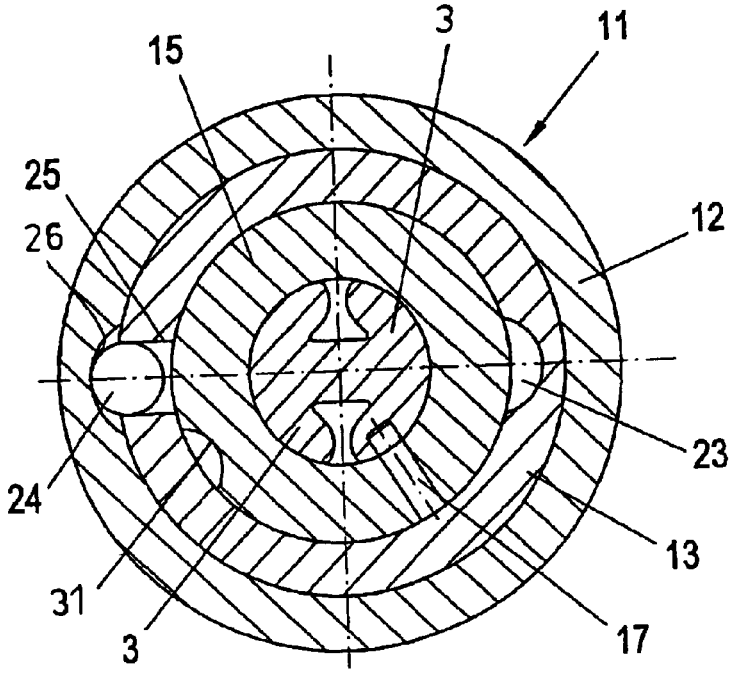
FIG. 11 is a section taken along plane XI—XI of FIG. 8, with a key inserted and the illustrated tumbler disk in the locking position.
Figure 12:
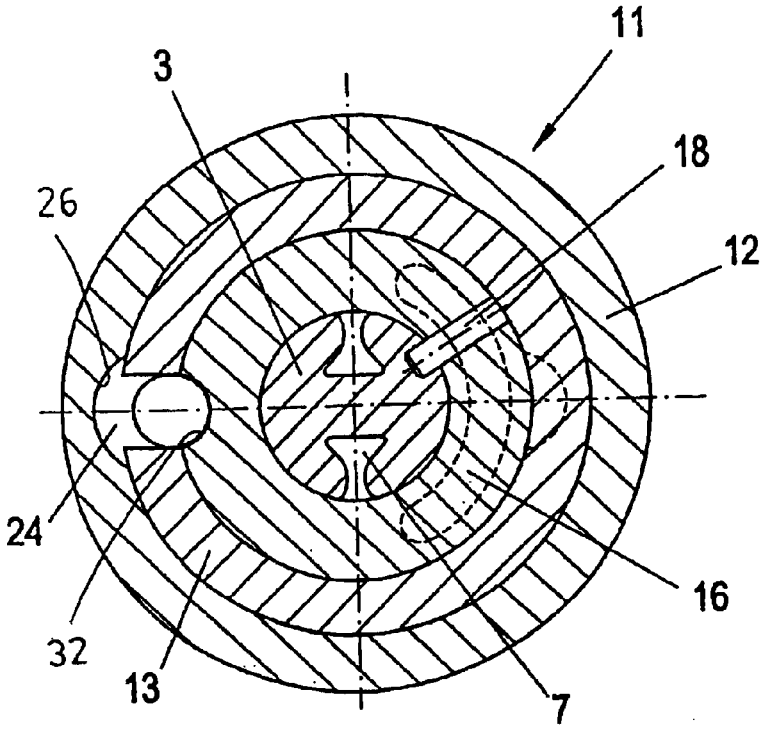
FIG. 12 is a view like FIG. 11 but with the illustrated tumbler disk in the freeing position.
Figure 13:
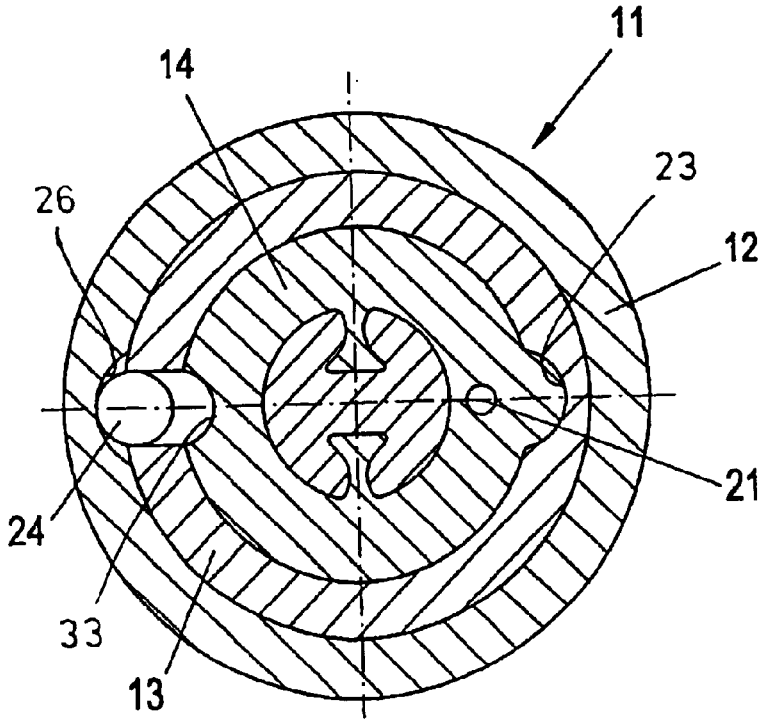
FIG. 13 is a section taken along plane XIII—XIII of FIG. 8 with a key inserted.

The lock described above functions as follows:

When there is no key 3 in the passage 30 formed by the annular disks 14, 15, and 16 the seats 31 and 32 will not radially confront the groove 26 as shown for a disk 15 in FIG. 11 and the rod 24 will be forced to project into the groove 26 of the stationary housing 12. Thus the plug 13 is solidly locked in the housing 12 by the rod 24 along almost its entire length, and this rod 24 in turn bears radially inward on nine disks 14 and 15 so that it is solidly prevented from moving inward.

Insertion of a blade 3 of a key 1 with the appropriately formed grooves 4, 5, and 6 will cause the pins 17 to fit with the grooves 4 and 5 and the pins 18 with the groove 6. Movement into the passage 30 will therefore angularly displace the disks 14 and 15 as the respective pins 17 and 18 ride along the nonstraight grooves 4, 5, and 6 until, when the key 1 is fully inserted, each seat 31 and 32 is radially aligned with the seat 26 as shown for a disk 16 in FIG. 12. In this position the rod 24 is free to move radially inward.

Although not illustrated, as described in the above-identified patent, lock elements or balls fitted to and radially displaceable in the plug 13 can engage radially into the seats 8 and 9 on the key blade 3 when the plug 13 is turned out of its locked position, inhibiting retraction of the key 1.

The front ends of the grooves 4, 5, and 6 are so positioned that, when the key 1 is retracted, the disks 15 and 16 are set in positions with their seats 31 and 32 angularly offset from the rod seat 26, ensuring that all nine of the disks 15 and 16 are effective in locking the system.

I claim:

1. A key having a blade formed with a part-cylindrical face, the blade further being formed with:

a pair of relatively shallow, outwardly open, and generally parallel but spaced grooves formed in the face extending generally longitudinally in a nonstraight path; and a relatively deep and outwardly open groove formed in the face and extending generally longitudinally in a nonstraight path generally nonparallel to the shallow grooves, the grooves each having a plurality of control positions at which they extend substantially parallel to the blade, the grooves being inclined to the blade between the respective control positions, the control positions of the shallow grooves being transversely aligned and staggered relative to the control positions of the deep groove.

2. The key defined in claim 1 wherein the deep groove is mainly between the shallow grooves.

3. The key defined in claim 1 wherein the grooves all flare axially toward a tip of the key.

4. The key defined in claim 1 wherein the key blade is solid and cylindrical.

5. The key defined in claim 1 wherein the key blade is cylindrical and has a second part-cylindrical face substantially identical to the first-mentioned part-cylindrical face and formed with second shallow and deep grooves like the first-mentioned shallow and deep grooves.

6. The key defined in claim 5 wherein the key blade is substantially symmetrical to a plane extending between the first and second faces.

7. The key defined in claim 1 wherein the blade is formed with at least one axially extending ward formation.

8. The key defined in claim 7 wherein the ward formation is a groove.

9. The key defined in claim 1 wherein the key blade is cylindrical and has a second part-cylindrical face substantially identical to the first-mentioned part-cylindrical face and formed with second shallow and deep grooves like the first-mentioned shallow and deep grooves, the key blade being substantially symmetrical to a plane extending between the first and second faces, the key blade being formed between the first and second faces with a pair of axially extending ward formations.

10. The key defined in claim 1 wherein the control positions of each groove are angularly offset from one another.

11. In combination with a key having a blade formed with a part-cylindrical face, the blade further being formed with:

a pair of relatively shallow, outwardly open, and generally parallel but spaced grooves formed in the face extending generally longitudinally in a nonstraight path; and a relatively deep and outwardly open groove formed in the face and extending generally longitudinally in a nonstraight path generally nonparallel to the shallow grooves, the grooves each having a plurality of control positions at which they extend substantially parallel to the blade, the grooves being inclined to the blade between the respective control positions, the control positions of the shallow grooves being transversely aligned and staggered relative to the control positions of the deep groove;

lock comprising:

a relatively stationary lock housing;

a lock cylinder rotatable in the housing about an axis and formed with an axially outwardly open passage shaped to snugly receive the key blade;

a first tumbler angularly displaceable in the cylinder and provided with a first formation engageable generally radially of the axis in the deep groove;

a second tumbler angularly displaceable in the cylinder and provided with a second formation engageable generally radially of the axis in the shallow grooves, whereby the tumblers are shifted angularly on insertion of the key by interengagement of the formations and the respective grooves; and a lock element displaceable in only one predetermined angular position of the tumblers between a position blocking rotation of the cylinder in the housing and a position permitting such rotation.

12. The combination defined in claim 11 wherein the second tumbler has two such second formations each complementary to a respective one of the shallow grooves and fixedly spaced angularly of the key blade relative to each other.

13. The combination defined in claim 12 wherein the deep groove is between the shallow grooves.

14. The combination defined in claim 12 wherein the grooves flare axially toward a tip of the blade.

15. The combination defined in claim 12 wherein the deep groove intersects at least one of the shallow grooves.

16. The combination defined in claim 12 wherein the tumblers are flat annular disks surrounding and defining the passage and lying in planes substantially perpendicular to the axis.

17. The combination defined in claim 16 wherein the element is a rod extending axially and the disks are formed with radially outwardly open notches in which the rod is engageable only in the one predetermined positions of the disks.

18. The combination defined in claim 12 wherein the lock is provided with a plurality of such first and second tumblers spaced axially.

19. The combination defined in claim 18, further comprising spacers between the tumblers.

* * * * *